US005117152A

United States Patent [19]

Duwaer et al.

[11] Patent Number: 5,117,152

[45] Date of Patent: May 26, 1992

[54] CATHODE RAY TUBE INCLUDING A MAGNETIC FOCUSING LENS

[75] Inventors: Arne L. Duwaer, Ossining, N.Y.; Willem M. van Alphen, Eindhoven, Netherlands

[73] Assignee: U.S. Philips Corporation, New York, N.Y.

[21] Appl. No.: 336,528

[22] Filed: Apr. 10, 1989

Related U.S. Application Data

[63] Continuation of Ser. No. 59,729, Jun. 9, 1987, abandoned.

[30] Foreign Application Priority Data

Jun. 11, 1986 [NL] Netherlands ..... 8601511

[51] Int. Cl.[5] ..... H01J 29/70

[52] U.S. Cl. ..... 313/426; 313/428; 313/430; 313/431; 313/433; 313/436; 313/440

[58] Field of Search ..... 313/412, 413, 426, 428, 313/430, 431, 433, 436, 437, 440, 442; 335/210, 212, 213; 315/368, 370

[56] References Cited

U.S. PATENT DOCUMENTS

| | | | |
|---|---|---|---|
| 2,994,803 | 8/1961 | Goldberg | 313/437 X |
| 3,150,284 | 9/1964 | Comeau | 313/442 X |
| 3,504,211 | 3/1970 | Takemoto et al. | 313/437 |
| 3,800,176 | 3/1974 | Gross et al. | 313/412 |
| 3,984,723 | 10/1976 | Gross et al. | 313/412 |
| 4,396,897 | 8/1983 | Sluijterman et al. | 335/212 |
| 4,401,917 | 8/1983 | Gerritsen | 313/413 |
| 4,443,737 | 4/1984 | van Tol | 313/440 X |
| 4,455,541 | 6/1984 | Nosaka | 313/428 |
| 4,468,587 | 8/1984 | Sluyterman | 313/442 X |
| 4,642,527 | 2/1987 | Takahasi et al. | 313/431 X |
| 4,654,616 | 3/1987 | Dodds et al. | 335/212 |
| 4,670,726 | 6/1987 | Ogata et al. | 335/212 |

*Primary Examiner*—Donald J. Yusko
*Assistant Examiner*—Michael Horabik
*Attorney, Agent, or Firm*—Robert J. Kraus

[57] ABSTRACT

A monochrome cathode ray tube including a magnetic focusing device provided with means for generating a static magnetic focusing field. These means surround the neck of the cathode ray tube without contacting this neck, and a system of correction coils for generating an additional focusing field and 2-, 4- and/or 6-pole fields is provided coaxially between these means and the neck of the tube.

13 Claims, 1 Drawing Sheet

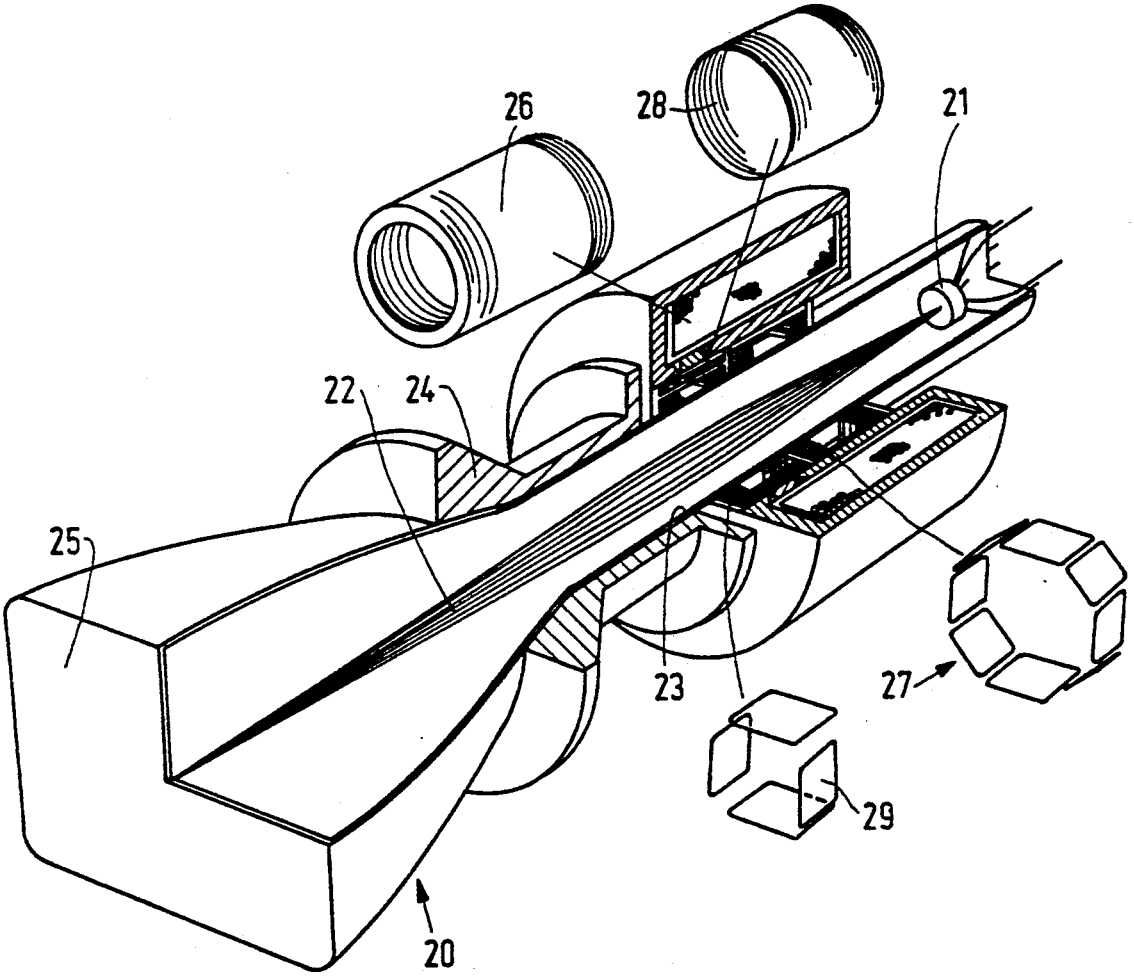
26
28
21
22
24
25
23
27
29
20

CATHODE RAY TUBE INCLUDING A MAGNETIC FOCUSING LENS

This is a continuation of application Ser. No. 059,729, filed Jun. 9, 1987, now abandoned.

BACKGROUND OF THE INVENTION

The invention relates to a monochrome cathode ray tube provided at one end with an electron gun and at the end located oppositely thereto with a display screen having a phosphor layer. A deflection unit is provided around the neck of the display tube and a magnetic focusing device is provided around the neck of the display tube between the electron gun and the deflection unit, which device has means for generating a static magnetic field.

When focusing electrons in a cathode ray tube, two types of lenses are used, viz. electrostatic or magnetic lenses. To achieve a good definition it is desirable to achieve a very good extent of focusing (small electron spot or high resolution). Magnetic lenses can generally be provided outside the neck of the tube, in contrast to electrostatic lenses which are present in the neck of the tube. Therefore the diameter of the magnetic lenses may be larger, which yields a better lens quality: the spherical aberration decreases with an increasing lens diameter. A smaller spherical aberration leads to a smaller spot on the screen, which is required for high-resolution guns. Consequently, a magnetic focusing lens is preferably used for high-resolution (projection) television tubes.

When magnetic focusing lenses are used, a distinction can be made between two types, viz. electromagnetic and magnetostatic lenses. In an electromagnetic lens a field is generated by a coil which is partially enclosed by a yoke. In a permanent magnetic lens the field is generated by a permanent magnetic material with or without a yoke (see German Patent 891,119). The electron beam is moved across the screen by a deflection coil, while the intensity of the beam is modulated for obtaining a picture. The large beam aperture angle which occurs at a large intensity of the electron beam results in the electron spot on the screen being not only enlarged but also distorted during deflection of the beam by the deflection coil. As a result of this deflection defocusing an elliptical spot having a diameter which is larger than that in the center of the display screen is produced on the edge of the screen.

In some uses of cathode ray tubes, such as projection television tubes or so-called data-graphics display tubes such a distortion cannot be tolerated.

SUMMARY OF THE INVENTION

It is an object of the invention to provide a cathode ray tube of the type having a magnetic focusing lens in such a manner that a high resolution is accompanied by a minimum power dissipation in the driver amplifier(s). This object is solved in a cathode ray tube according to the invention in that the means for generating a static magnetic dipole field directly adjoin the deflection unit and surround the neck of the cathode ray tube in a spaced relationship, and in that a system of correction coils for generating 2-, 4- and/or 6-pole fields is provided coaxially between these means and the neck of the tube.

The invention is based on the following recognition.

For an optimum resolution the distance between focusing lens and display screen should be maintained as small as possible. If this is done, typically a small circular spot in the centre of the picture is always obtained. Only a static focusing lens is required for the center of the picture (an efficient embodiment is, for example, a focusing lens means of permanent magnetic material).

Although the spot in the center of the picture is then circular and small, the spot size increases towards the edge of the picture and becomes elliptical. This decrease in resolution can be reduced by modulating the focusing field synchronously with the picture scan by 3–4% using a (rapid) focusing coil (at a low impedance). The largest resolution and the smallest power dissipation in the driver amplifier occurs if the dynamic focusing coil is placed in the same position as the static focusing lens (as close as possible to the display screen). The remaining spot growth towards the edge of the picture can be eliminated by modulating 2 quadrupole fields synchronously with the picture scan. The highest resolution and the smallest power dissipation again occurs in the driver amplifiers of the (rapid) quadrupole coils (at a low impedance) if these quadrupoles are positioned as close as possible to the display screen, thus also in the same position as the static focusing lens. According to the invention, to realize this a magnetic focusing lens having an (en)large(d) diameter is used within which the required correction coils are provided coaxially.

For an efficient drive of a (rapid) raster correction or convergence coil (having a low impedance) this coil must also be positioned as close as possible to the display screen, hence within the magnetic focusing lens. A first embodiment of the invention is therefore characterized in that the system of correction coils generates two dipole fields for correcting the geometry of the raster formed on the display screen.

More particularly a cathode ray tube according to the invention is characterized in that the system of correction coils generates two 4-pole fields for correcting astigmatic errors, and in that the system of correction coils generates two 4-pole fields and two 6-pole fields for correcting higher order spot distortions.

The two latter embodiments may or may not be combined with the first-mentioned embodiment.

A further embodiment of the invention is characterized in that the system of correction coils includes a dynamic focusing coil.

BRIEF DESCRIPTION OF THE DRAWING

An embodiment of the invention will be described in greater detail with reference to the drawing. The drawing is a broken-up elevational view of a cathode ray tube including a system of correction coils according to the invention.

DESCRIPTION OF THE PREFERRED EMBODIMENT

As explained above, the invention provides for the increase of the inner diameter of the focusing lens and positioning a system of correction coils between the focusing lens and the neck of the tube. This embodiment is shown in the drawing.

An electron beam 22 is generated by an electron gun 21 in a cathode ray tube 20. A deflection yoke 24 with which the electron beam 22 is moved across a phosphor screen 25 is provided around the neck 23 of the tube 20. A static magnetic focusing coil 26 having an enlarged inner diameter is provided directly behind the deflection yoke 24 around the neck 23 of the tube. The magnetic focusing coil 26 is thus positioned as close as possible to the phosphor screen 25 for the purpose of a maximum possible resolution. A dynamically controlled multipole coil 27 is positioned coaxially within the focusing coil 26, with which a magnetic 4-pole field can be generated for correcting deflection astigmatism. Furthermore a dynamically controlled magnetic focusing coil 28 and a dynamically controlled convergence coil 29 are provided coaxially within the static focusing coil 26. Two dipole fields can be generated with the convergence coil 29 in order to correct the geometry of the raster and to make the red, green and blue images accurately coincide in projection television.

According to the invention the multipole correction coil is provided at the area where the beam diameter in the tube is largest. At this large beam diameter the sensitivity of the multipole coil is also highest. This is the case at the area of the magnetic lens. The fact that it is desirable to place the focusing coil as close as possible to the screen in connection with the resolution of the tube also plays a role.

The invention is based on the following recognitions:

i) when positioning the convergence coil behind the focusing lens (near the electron gun) the deflection sensitivity of this convergence coil is impractically low because the operation of the magnetic focusing lens is based on the rotating "compression" of the electron beam towards the center line of the lens and because the magnetic field of the convergence coil is partly shielded from the electron beam by the metal of the electron gun. In addition the electron beam will traverse the focusing lens in a more excentric way so that the rotation of the geometrical corrections becomes larger and more astigmatism is introduced.

ii) When the picture distance is reduced and the focusing distance is increased the enlargement of a picture and hence the minimum achievable picture size decreases in a reproducing system.

iii) When the inner diameter of a magnetic focusing lens is increased, the spherical aberration of this lens decreases. The increase in spherical aberration which is to be expected upon an increase of the focusing distance due to an enlargement of the effective diameter of the electron beam to be focused at the area of the focusing lens can be amply eliminated thereby.

iv) In the case of mutually perpendicular orientations of coils the mutual inductance is low.

v) Providing copper in a magnetic field will affect this field to a negligible extent because copper is diamagnetic and has a magnetic permeability which differs by only 0.001% from the magnetic permeability of a vacuum.

vi) Interactions between the magnetic focusing field on the one hand and deflection and convergence fields on the other hand primarily become manifest at large inner diameters of the magnetic focusing lens as a rotation of the picture on the phosphor screen and as a rotation of the geometrical corrections provided. These rotations can be eliminated by opposite and equally large rotations of deflection and convergence coils.

The following advantages are obtained with the proposed integration of multipole correction coil and focusing coil:

i) A compact electron-optical system has been obtained around the cathode ray tube with which the maximum achievable resolution has increased by approximately 15% while maintaining the possibility of dynamic focusing and accurate dynamic convergence.

ii) Due to the compactness of the proposed electron-optical system the length of the neck of the cathode ray tube may be reduced so that again a gain in resolution can be made. A short cathode ray tube is also of great importance for constructing small projection television sets for consumer uses.

The invention can be used in the field of monochromatic, high-resolution cathode ray tubes which, as one possibility, can be built in a projection television set.

What is claimed is:

1. A monochromatic cathode ray tube comprising:

a. an envelope including a neck portion containing an electron gun for producing an electron beam and an enlarged portion containing a luminescent screen for producing a spot when impinged by said beam;

b. a deflection unit disposed around the neck portion for effecting deflection of the electron beam across the screen;

c. a magnetic focusing device disposed around the neck portion for producing a static magnetic dipole field for focusing the electron beam onto the screen, said device being directly adjacent the deflection unit and being spaced from said neck portion; and d. a system of correction coil means, each coaxially-disposed between the neck portion and the magnetic focusing device for producing a respective dynamic magnetic multipole correction field in cooperation with the static magnetic dipole field to dynamically correct a specific type of distortion which occurs as the electron beam is deflected across the luminescent screen.

2. A cathode ray tube as in claim 1 where the system of dynamic correction coil means is disposed around the neck portion where the electron beam diameter is at a maximum.

3. A cathode ray tube as in claim 1 or 2 where the system of dynamic correction coil means includes a coil means for producing two dipole fields for correcting the geometry of a raster formed by the deflected electron beam.

4. A cathode ray tube as in claim 1 or 2 where the system of dynamic correction coil means includes a coil means for producing two four-pole fields for correcting astigmatic errors.

5. A cathode ray tube as in claim 1 or 2 where the system of dynamic correction means includes a coil means for producing two four-pole fields for correcting astigmatic errors and a coil means for producing two six-pole fields for correcting higher order spot distortions.

6. A cathode ray tube as in claim 1 or 2 where the system of dynamic correction coil includes a dynamic focusing coil means.

7. A monochromatic cathode ray tube comprising:

a. an envelope including a neck portion containing an electron gun for producing an electron beam and an enlarged portion containing a luminescent screen for producing a spot when impinged by said beam;

b. a deflection unit disposed around the neck portion for effecting deflection of the electron beam across the screen;

c. a magnetic focusing device disposed around the neck portion for producing a static magnetic dipole field for focusing the electron beam onto the screen, said device being directly adjacent the deflection unit and being spaced from said neck portion; and d. a system of independent correction coil means, each coaxially-disposed within the magnetic focusing device between said device and the neck portion for producing respective dynamic magnetic multipole correction fields in cooperation with the static magnetic dipole field to dynamically correct a specific type of distortion which occurs as the electron beam is deflected across the luminescent screen, said correction coil arrangements including:

(1) a first coil means for dynamically correcting focusing of the electron beam; and (2) a second coil means for dynamically correcting astigmatism of the electron beam.

8. A cathode ray tube as in claim 7 where the correction coil means include a third coil means for dynamically correcting the geometry of a raster image formed on the screen by the deflected electron beam.

9. A cathode ray tube as in claim 7 or 8 where the first and second coil means are disposed adjacent each other.

10. A cathode ray tube as in claim 8 where the third coil means is disposed within the first coil means.

11. A cathode ray tube as in claim 7 or 8 where the system of independent correction coil means is disposed around the neck portion where the electron beam diameter is at a maximum.

12. A cathode ray tube as in claim 8 where the third coil means is configured to produce two dipole fields.

13. A cathode ray tube as in claim 7 or 8 where the second coil means is configured to produce two four-pole fields.

* * * * *